US008915040B2

(12) United States Patent
James

(10) Patent No.: US 8,915,040 B2
(45) Date of Patent: Dec. 23, 2014

(54) PLASTIC BARRIERS

(71) Applicant: AXIP Limited, Auckland (NZ)

(72) Inventor: Dallas Rex James, Auckland (NZ)

(73) Assignee: Valmont Highway Technology Limited, Auckland (NZ)

( * ) Notice: Subject to any disclaimer, the term of this patent is extended or adjusted under 35 U.S.C. 154(b) by 0 days.

(21) Appl. No.: 13/630,735

(22) Filed: Sep. 28, 2012

(65) Prior Publication Data

US 2013/0081348 A1 Apr. 4, 2013

(30) Foreign Application Priority Data

Sep. 29, 2011 (NZ) ..... 591975

(51) Int. Cl.
*E04B 2/00* (2006.01)
*E01F 15/08* (2006.01)

(52) U.S. Cl.
CPC ..... *E01F 15/088* (2013.01); *E01F 15/086* (2013.01)
USPC ..... 52/588.1; 52/220.2; 52/302.4; 404/6; 404/9

(58) Field of Classification Search
USPC ..... 52/588.1, 220.1, 220.2, 302.3, 302.4; 404/6, 9; 256/26
See application file for complete search history.

(56) References Cited

U.S. PATENT DOCUMENTS 4,500,225 A * 2/1985 Quittner ..... 404/6
4,681,302 A * 7/1987 Thompson ..... 256/13.1
4,946,306 A * 8/1990 Yodock ..... 404/6
4,954,009 A * 9/1990 Kellison ..... 404/6
5,208,585 A * 5/1993 Sprague ..... 340/908.1
5,286,136 A * 2/1994 Mandish et al. ..... 404/6
5,498,101 A * 3/1996 Braverman ..... 404/6
5,531,540 A * 7/1996 Wasserstrom et al. ..... 404/6
5,605,413 A * 2/1997 Brown ..... 404/6
D400,264 S * 10/1998 Striefel et al. ..... D25/38.1
5,882,140 A * 3/1999 Yodock et al. ..... 404/6
6,059,491 A * 5/2000 Striefel et al. ..... 405/111
6,413,009 B1 * 7/2002 Duckett ..... 404/6
6,428,237 B1 8/2002 Duckett
6,474,904 B1 11/2002 Duckett et al.
6,666,616 B2 * 12/2003 Yodock et al. ..... 404/6
6,669,402 B1 * 12/2003 Davis et al. ..... 404/6
D498,163 S * 11/2004 Brown ..... D10/113.3
7,351,002 B2 * 4/2008 Yodock et al. ..... 404/6
7,351,008 B2 * 4/2008 Yodock et al. ..... 405/71
7,537,411 B2 * 5/2009 Yodock et al. ..... 404/6
7,547,157 B2 * 6/2009 Yodock et al. ..... 404/6
7,600,942 B2 * 10/2009 Yodock et al. ..... 404/6
7,811,025 B2 * 10/2010 Kulp et al. ..... 404/6

(Continued)

FOREIGN PATENT DOCUMENTS

GB 1259769 1/1972

*Primary Examiner* — William Gilbert
*Assistant Examiner* — Gisele Ford
(74) *Attorney, Agent, or Firm* — Greer, Burns & Crain, Ltd.

(57) ABSTRACT

A temporary plastic barrier section includes a plastic shell having first and second plastic connection portions integrally formed on opposite ends thereof; and a rigid straight elongate member, wherein the rigid straight elongate member lies substantially adjacent to at least a portion of each of the first and second connection portions, and wherein the rigid straight elongate member includes connection points at the distal ends thereof which are configured to align substantially with the first and second connection portions.

11 Claims, 4 Drawing Sheets

(56) References Cited

U.S. PATENT DOCUMENTS

| | | | | |
|---|---|---|---|---|
| 7,866,913 | B2 * | 1/2011 | Kulp et al. | 404/6 |
| D634,443 | S * | 3/2011 | Taylor | D25/38.1 |
| 7,931,422 | B2 * | 4/2011 | Kulp et al. | 404/6 |
| 8,172,204 | B2 * | 5/2012 | Serafin | 256/13.1 |
| 8,182,169 | B2 * | 5/2012 | Thompson et al. | 404/6 |
| 8,235,625 | B1 * | 8/2012 | Kulp et al. | 404/6 |
| 8,376,651 | B2 * | 2/2013 | Kulp et al. | 404/6 |
| 8,388,257 | B2 * | 3/2013 | Redlberger | 404/6 |
| 8,393,822 | B2 * | 3/2013 | Hotchkin | 404/6 |
| 8,453,995 | B2 * | 6/2013 | Christensen et al. | 256/13.1 |
| 8,474,195 | B1 * | 7/2013 | Anchondo | 52/168 |
| 8,491,217 | B2 * | 7/2013 | Kulp et al. | 404/6 |
| 8,545,126 | B1 * | 10/2013 | Alsaffar | 404/6 |
| 2003/0113161 | A1 | 6/2003 | Yodock, III et al. | |
| 2009/0060650 | A1 | 3/2009 | Kulp et al. | |
| 2010/0196094 | A1 | 8/2010 | Kulp et al. | |

* cited by examiner

PLASTIC BARRIERS

TECHNICAL FIELD

The present invention relates to improvements in plastic barriers. The present invention has particular application in regard to plastic barriers which, in use, form a section of a temporary plastic wall.

BACKGROUND

Plastic shell barriers are used in situations whereby a temporary safety measure is required. Plastic shell barriers are convenient in that when they are empty they are easy to transport and position as required due to their relatively light weight. Once in position plastic barriers are typically interconnected together to form a temporary barrier wall and filled with water so as to provide the barrier wall with sufficient inertia to resist and absorb impact energy during a collision. During a collision it is the purpose of the barrier wall to re-direct an impacting vehicle back onto a roadway.

One problem that exists with walls formed by a plurality of plastic barriers is that when any one barrier is impacted by a vehicle, that barrier may be pushed out of alignment with an adjacent barrier. This misalignment results in a kink or step being formed in the wall of barriers. This step or kink in the wall may result in the impacting vehicle becoming hooked by the kink or step and being spun or flipped. Ideally a temporary barrier wall should maintain alignment between adjacent barrier sections so that an impacting vehicle is re-directed away from the barrier wall at an angle of incidence substantially equal to or less than the impact angle.

Attempts to maintain alignment between adjacent barriers have been made by connecting adjacent barriers at their ends. Due to the nature of the material used to construct temporary shell barriers this requires additional reinforcing at the point of connection so as to maintain the integrity of the connection in the event of an impact. Further to the integrity of the connections, plastic shell barriers can exhibit deformation in the form of stretching, whereby the body of the impacted barrier and potentially both the impacted barrier and adjacent barrier connection there between stretch and deform. This deformation is due to the inability of the plastic material of the connections and body of the barrier to withstand the force required to move the mass of an adjacent barrier; which will typically be filled with water. The mass of a water filled barrier could be as much as 400-1000 Kg. Deformation of the connections or body of a barrier again leads to the kinking/stepping problem noted earlier.

Prior art barriers such as that recited in U.S. Pat. No. 5,425,594 teach the addition of wire cable and internal metal frameworks to provide additional resiliency to the longitudinal axis of the barrier. However such systems are complicated to manufacture and the wire cable requires tensioning in order to provide adequate tensile strength. Without sufficient tensile strength the barriers are still capable of being deformed and causing kinking or steps in a barrier wall and therefore the risk of an impacting vehicle being spun or flipped.

It will be apparent to a person skilled in the art, that an orthogonally directed impact with a single temporary plastic barrier will, depending on the inertia of the barrier and mass of the impacting object, result in that barrier being shunted in the direction of the impact. This shunting could potentially cause damage to anything on the non-impact side of the barrier, a small child for example. However, if the temporary plastic barrier forms part of an interconnected chain of temporary plastic barriers, the inertia of the impacted barrier is greatly increased. The reason for this is that an orthogonal impact force is translated via the connection portions into a longitudinal force along the line of interconnected barriers. This places a large amount of force on the connection portions as well as the body portion of the barrier sections; particularly those at or near any point of impact.

It would therefore be useful for there to be provided an easily manufacturable plastic shell barrier which is capable of being connected to adjacent plastic shell barriers and which exhibits a high resistance to tensional forces such that kinking is minimised.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

SUMMARY

According to one aspect of the present invention there is provided a temporary plastic barrier section including:

a plastic shell having first and second plastic connection portions integrally formed on opposite ends thereof; and a rigid straight elongate member, wherein the rigid straight elongate member lies substantially adjacent to at least a portion of each of the first and second connection portions and wherein the rigid straight elongate member includes connection points at the distal ends thereof which are configured to align substantially with the first and second connection portions, or form an additional connection portion.

In preferred embodiments the plastic barrier shell includes a passage which receives the rigid straight elongate member which passes from an aperture near to, or substantially adjacent, the first connection portion to a position adjacent to the second connection portion.

It will be apparent to a person skilled in the art that the barrier shell could take any number of shapes without departing from the scope of the present invention.

It will be apparent to a person skilled in the art that a barrier shell may include connection portions in the form of recessed and/or protruding elements. Each type of connection can be configured such that the rigid straight elongate member is adjacent the connection and either fully contained within the barrier shell or having one or more ends positioned outside the barrier shell.

It will also be apparent to a person skilled in the art that any number of implementations exist for the operation of the connection portions, as such the type of connection used should not be seen as limiting. Examples of connection systems used in barriers include:

interlinking projections and recesses, wherein the connection portions of adjacent barriers interlink and are held together by passing a rigid pin or rod vertically through the interlinked components;

hook members, wherein one barrier includes a hooked protrusion which is hooked into a complementary recess in an adjacent barrier. These types of barriers are lifted and lowered into position to hook them together; this is performed when the barrier is empty of any ballast. Once hooked together the barriers are filled with fluent material the mass of which makes it very difficult to unhook the barriers.

In preferred embodiments the first and second connection portions are complementary. It will be understood that complementary connections allow adjacent plastic barriers shells to be directly connected together, the first connection of one barrier connecting to the second connection of an adjacent barrier.

In some embodiments the first and second connection portions may be identical. It will be apparent to a person skilled in the art that identical connections require a further component for interconnection between barrier shells, a non-limiting list of such components includes pins, 'U' shaped pins, link members or the like wherein one half of the 'U' or link member attaches to a first barrier shell and the other half attaches to an adjacent barrier shell.

In preferred embodiments the rigid straight elongate member exhibits sufficient tensile strength to substantially resist any longitudinally directed impact forces and may be configured to pass through the shell such that one, or both ends of the rigid straight elongate member lie outside the shell.

In some preferred embodiments the rigid straight elongate member may be configured to shear or break when subjected a direct impact substantially orthogonal to the longitudinal axis of the rigid elongate member. It will however be apparent to a person skilled in the art that the rigid straight elongate member is shielded from orthogonally directed impact forces by the barrier shell and therefore the rigid straight elongate member will only sheer or break if the shell is compromised and the rigid straight elongate member is impacted directly.

In preferred embodiments the rigid straight elongate member provides tensile strength to substantially resist any longitudinal deformation of the plastic shell.

In preferred embodiments the rigid straight elongate member is a substantially straight steel bar.

In preferred embodiments the plastic shell is hollow. The advantages of a hollow barrier shell are known in the art and include ease of transport when the shell is empty and on site filling with a liquid or particle material such as, but not limited to, water, gravel or sand for increased inertia.

In preferred embodiments the plastic shell has a base region and includes:

a first aperture therein positioned adjacent the first connection portion; and a second aperture therein positioned adjacent the second connection portion, wherein the apertures are aligned substantially parallel with respect to the plane of the base region on opposing ends of the plastic shell.

In some preferred embodiments the plastic shell may include baffles, ribs, bracing or the like therein, the internal structure of the plastic shell should therefore not be seen as being limiting.

According to a further aspect of the present invention there is provided a plastic shell for a temporary plastic barrier section, the plastic shell including:

a first and a second connection portion integrally formed on opposite ends of the plastic shell; and a passage which passes from an aperture near to, or substantially adjacent the first connection portion, to a position near to, or substantially adjacent to, the second connection portion.

In especially preferred embodiments the rigid straight elongate member is configured to:

pass through the passage; and lie near to, or substantially adjacent to at least a portion of, each of, the first and second connection portions.

According to a further aspect of the present invention there is provided a rigid straight elongate member for use with a plastic shell; the plastic shell including a first and a second connection portion integrally formed on opposite ends of the plastic shell; and having a passage which passes from an aperture near to or substantially adjacent the first connection portion to a position near to or substantially adjacent to the second connection portion;

wherein the rigid straight elongate member is configured to be passed through the passage in the plastic shell and includes at least one connection point at substantially each end thereof; and wherein the rigid straight elongate member is configured so that when located in the plastic shell by way of the at least one aperture the at least one connection point in each end of the rigid straight elongate member lies substantially adjacent to a corresponding connection point located in the first and second connection portions of the said plastic shell.

In preferred embodiments the connection portions adjacent to which the ends of the rigid straight elongate member are positioned are located in, or upon, the upper half of the barrier shell.

In especially preferred embodiments the connection portions adjacent to which the ends of the rigid straight elongate member are positioned are located substantially at, or near, the top of the barrier shell.

The occurrence of vehicles impacting and riding up and over barriers is well known in the art of plastic barriers. The reason for this phenomenon is that during impact the tyre of an impacting vehicle will inevitably make contact with the bottom of a barrier. Because of the grip of the tyre, rather than pushing the barrier back, the tyre may roll up the face of the barrier, causing the vehicle to flip, or to ride up and over the barrier. If the barrier is attached to adjacent barriers by way of a rigid straight elongate member, and at a high connection point, the barrier can swing about the axis of the rigid straight elongate member. This creates a barrier section which has greater moment of inertia in the upper region of the barrier than in the bottom region of the barrier. Consequently the bottom of the barrier is pushed inwards during initial impact resulting in a reduced chance of contact between the tyre and the barrier.

According to a further aspect of the present invention there is provided a wall formed from a plurality of interconnected temporary plastic barrier sections, wherein one or more of the temporary plastic barrier sections includes a plastic shell having first and second connection portions integrally formed on opposite ends thereof, and a rigid straight elongate member lying substantially adjacent to at least a portion of each of the first and second connection portions, wherein:

each temporary plastic barrier section is interconnected by way of the first and/or second connection portion to an adjacent temporary plastic barrier section; and wherein connection between adjacent temporary plastic barrier sections attaches:

the connection portions of adjacent plastic shells together;

the rigid straight elongate members of adjacent plastic barrier sections together.

A barrier forming a section of a temporary barrier wall, the barrier including a rigid straight elongate member passing from a first end to a second end of the barrier, wherein the respective ends of the rigid straight elongate member are configured to be connected to the rigid straight elongate member of an adjacent barrier section.

Interconnection between the connection portions of a plastic barrier shell with an associated rigid straight elongate member results in a plastic barrier shell in which the connection portions are held substantially rigidly with respect to each other. It will be apparent to a person skilled in the art that both tensile and, to a lesser extent, compressive forces applied to the connection portions of a temporary plastic barrier which forms a section of a plurality of interconnected plastic barrier shells will be passed along the length of the rigid straight elongate member to the rigid straight elongate member of an adjacent barrier.

In preferred embodiments the first connection portion of a barrier is complementary with the second connection portion of an adjacent barrier.

In preferred embodiments each of the first and second connection portions include one or more apertures therethrough.

In preferred embodiments the apertures in the first and second connection portions align coaxially with apertures in the portions of the rigid straight elongate member which lie adjacent the connection portions.

In preferred embodiments the apertures of the first and second connection portions of adjacent barriers may be aligned coaxially.

In preferred embodiments a single connecting element may be passed through the coaxially aligned apertures of the first connection portion and rigid straight elongate member of a first barrier and the second connection portion and rigid straight elongate member of an adjacent barrier.

In preferred embodiments the connecting element may be a steel pin or rod, however the connecting element could take any number of forms without departing from the scope of the present invention, and therefore should not be seen as being limiting.

In preferred embodiments the end most barrier may not include an rigid straight elongate member as a head end on impact with the endmost barrier may result in compression of the plastic barrier shell along the length of the rigid straight elongate member potentially resulting in the skewering of the impacting vehicle by the length of rigid straight elongate material.

In preferred embodiments the temporary plastic barrier shell includes a base portion. The base portion of the temporary plastic barrier is configured to abut and frictionally engage a ground surface. It will be apparent to a person skilled in the art that frictional engagement of the base with a ground surface restricts movement of the temporary plastic barrier across that ground surface during an impact.

Preferred embodiments of the present invention may provide a number of advantages over the prior art, including but not limited to:

reducing the occurrence of barrier sections being shifted out of line with adjacent barrier sections during an impact, and thereby reducing the chance of a vehicle being spun or flipped;

increasing the inertia of individual barrier sections by transferring impact energy along the integrated rigid straight elongate member and into adjacent barrier sections;

increasing the tensile resiliency of barrier sections due to the rigid straight elongate member resisting any elongation of the plastic shell or connection portions during an impact.

BRIEF DESCRIPTION OF THE DRAWINGS

Further aspects of the present invention will become apparent from the following description which is given by way of example only and with reference to the accompanying drawings in which.

DETAILED DESCRIPTION

Figure 1:
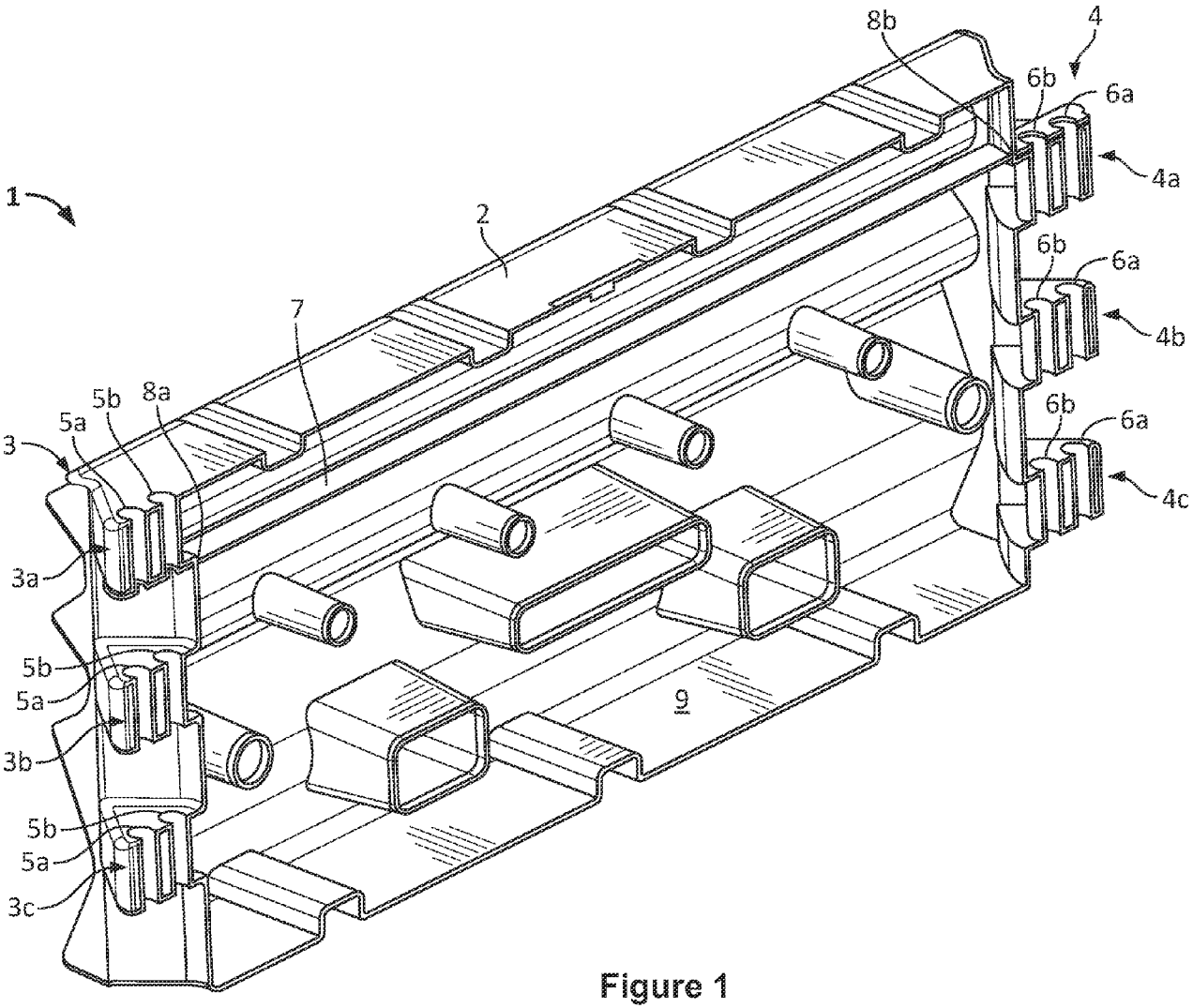
FIG. 1 shows a cross sectional isometric view of a barrier section according to one preferred embodiment of the present invention.

With respect to FIG. 1 there is shown a temporary barrier section as generally indicated by arrow 1. Temporary plastic barrier section 1 has a plastic shell 2 which is shown in cross-section through the vertical sagittal plane. The temporary plastic barrier shell has first connection portion 3 and second connection portion 4 located on opposite ends of thereof.

First connection portion 3 includes three vertically spaced protruding interface members, indicated as 3*a*, 3*b* and 3*c*, each of which includes a leading vertically oriented aperture 5*a* and a trailing vertically oriented aperture 5*b* spaced apart from one another along the sagittal plane of the barrier. The leading vertically oriented apertures 5*a* and trailing vertically oriented apertures 5*b* of each protruding interface member 3*a*, 3*b*, 3*c* are coaxially aligned.

Second connection portion 4 is a vertically displaced mirror image of first connection portion 3, including three vertically spaced protruding interface members, indicated as 4*a*, 4*b* and 4*c*, each of which includes a leading vertically oriented aperture 6*a* and a trailing vertically oriented aperture 6*b* spaced apart from one another along the sagittal plane of the barrier. The leading vertically oriented apertures 6*a* and trailing vertically oriented apertures 6*b* of each protruding interface member 4*a*, 4*b*, 4*c* are coaxially aligned.

Figure 2:
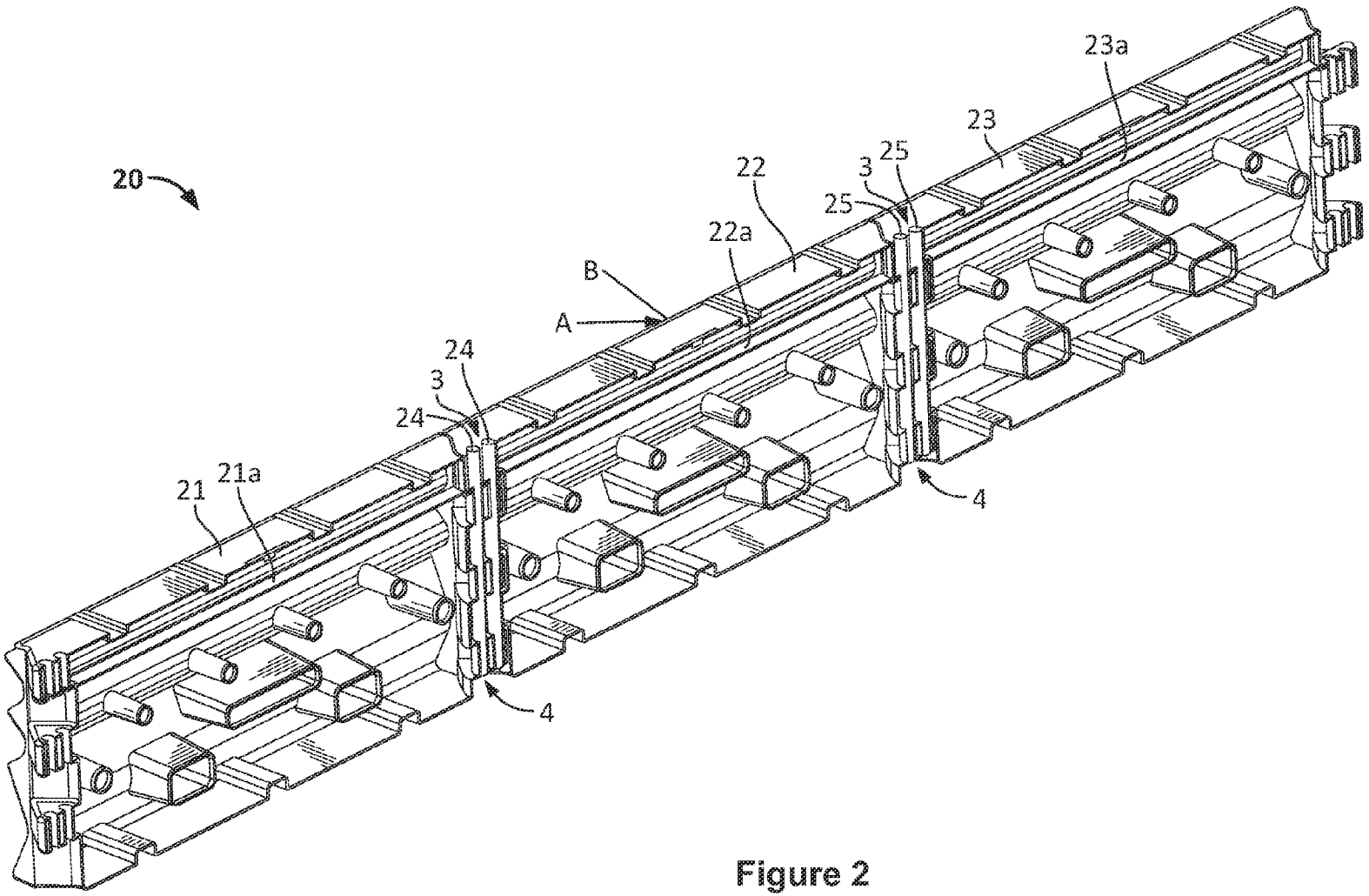
FIG. 2 shows a cross sectional isometric view of three of the barrier sections shown in FIG. 1 interconnected to form a temporary barrier wall in accordance with one aspect of the present invention.

The vertical spacing between the base of the plastic shell 2 and the three vertically spaced protruding interface members, 3*a*, 3*b*, 3*c*, of the first connection portion 3 is greater than the height between the base of the plastic shell 2 and the three vertically spaced protruding interface members 4*a*, 4*b*, 4*c* of the second connection portion 4. In use the three vertically spaced protruding interface members 4*a*, 4*b*, 4*c* of the second connection portion 4 of a first temporary barrier section interlace vertically with the three vertically spaced protruding interface members, 3*a*, 3*b*, 3*c*, of the first connection portion 3 of an adjacent temporary barrier section. This relationship is illustrated in FIG. 2.

Interlacing allows the option of:

1. Vertical alignment of the leading vertically oriented apertures 5*a* of a first connection portion 3 of a first barrier with the trailing vertically oriented apertures 6*b* of a second barrier. This position also results in alignment of the trailing vertically oriented apertures 5*b* of the first connection portion 3 with the leading vertically oriented apertures 6*a* of the second barrier. A locking rod inserted through each of the coaxially aligned apertures results in the barriers being held in fixed longitudinal alignment.
2. Vertical alignment of the leading vertically oriented aperture 5*a* of the first connection portion 3 of a first barrier with the leading vertically oriented apertures 6*a* of a second barrier. A locking bolt or rod inserted through the coaxially aligned leading apertures results in the barriers being engaged together but free to rotate through a limited angle about the locking bolt or rod.

It will be understood by a person skilled in the art that the connection portions could be attached together in any number of ways without departing from the scope of the present invention, examples may include but should not be limited to, bolts, u clamps, rods, pins or the like. The manner in which the barrier sections connect together should therefore not be seen as being limiting.

Temporary plastic barrier section 1 also includes a rigid straight elongate member in the form of steel bar 7. The steel bar 7 passes through the interior of plastic shell 2 and spans from first connection portion 3 to second connection portion 4. The steel bar 7 includes two apertures at each end thereof which align co-axially with the leading 5*a*, 6*a* and trailing 5*b*, 6*b* apertures in each of the first connection portion 3 and second connection portion 4.

Figure 3:
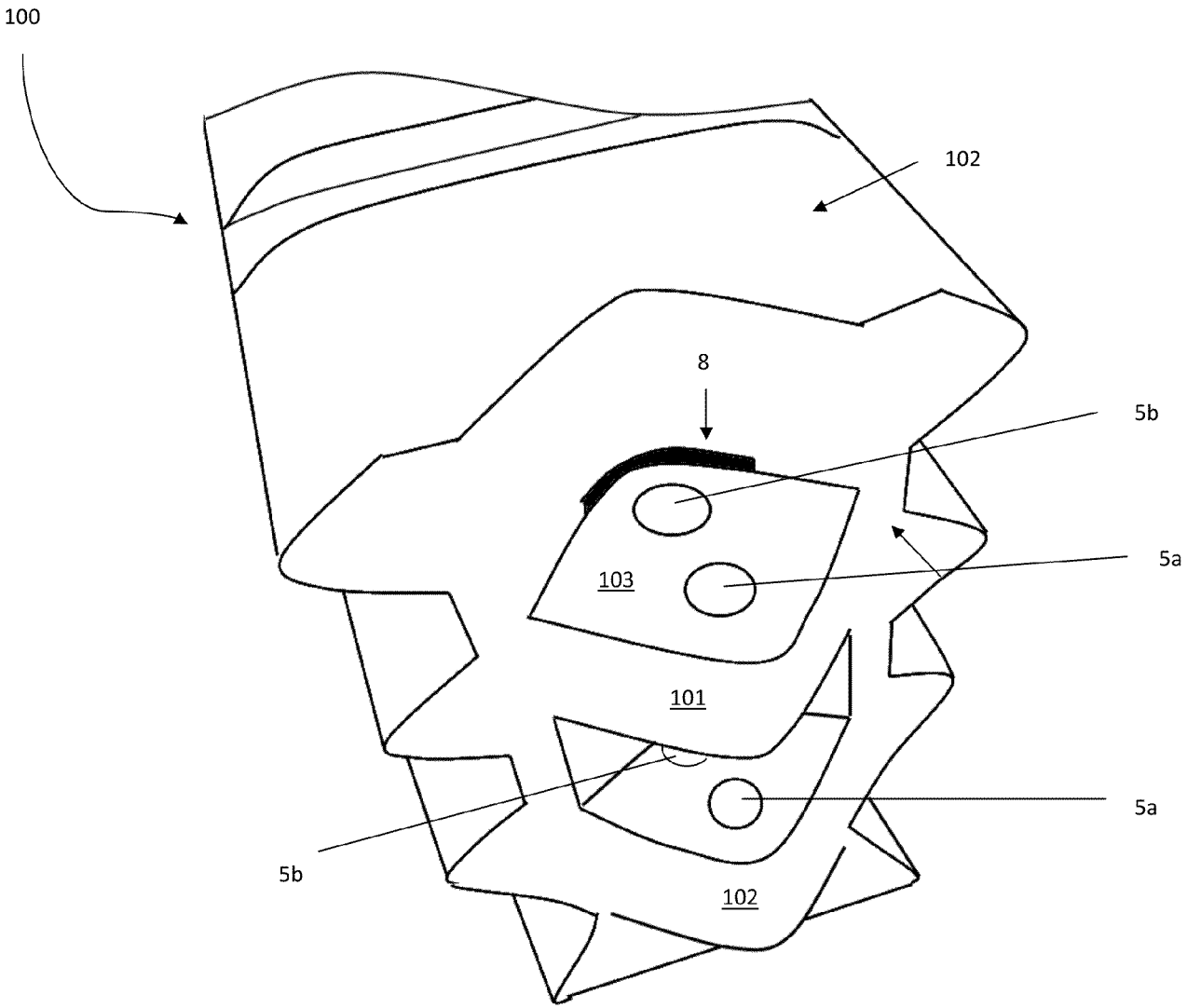
FIG. 3 shows an end view of a barrier section according to a further embodiment of the present invention.
Figure 4:
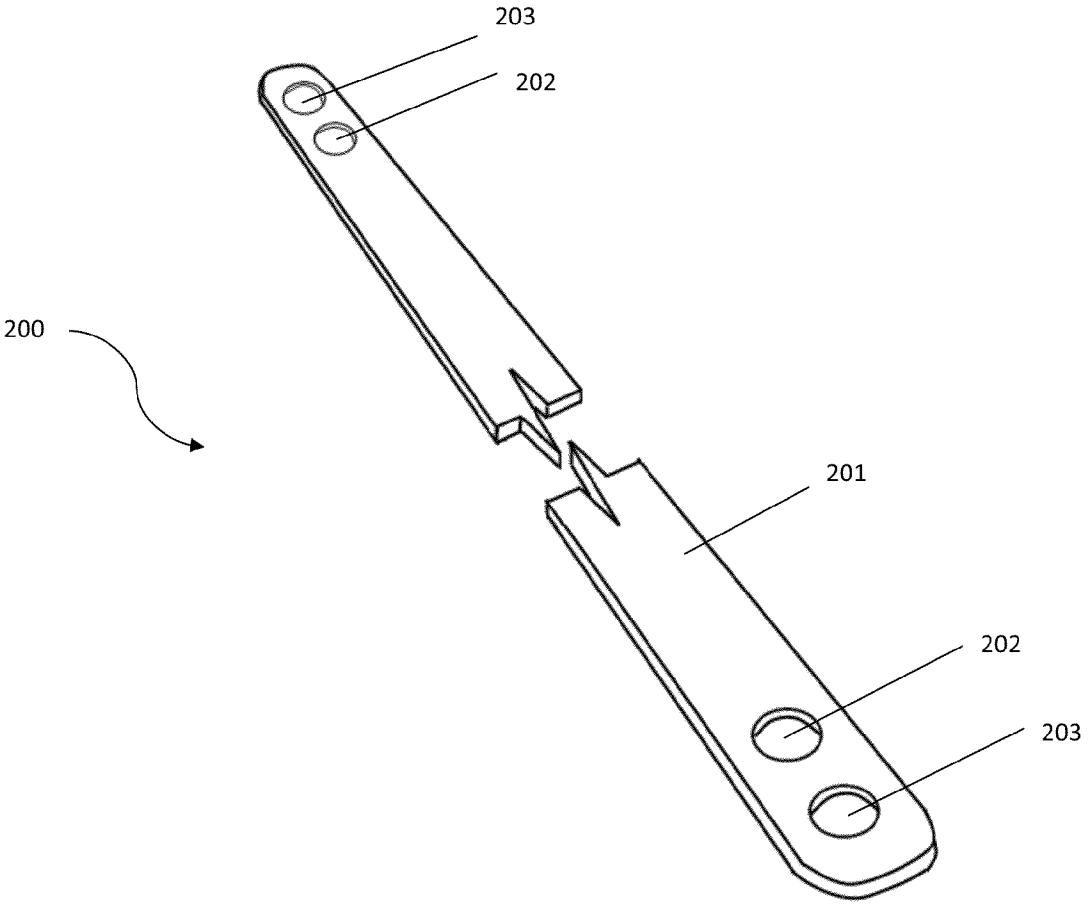
FIG. 4 shows an isometric view of one preferred embodiment of a rigid straight elongate member in accordance with the present invention.

Manufacture of shell 2 can be performed by way of rotary molding, the apertures 8*a*, 8*b* through which the ends of steel bar 7 protrude are formed in the shell after rotary molding, by way of cutting a slot in the shell 2, thereby forming a passage through the shell 2 through which steel bar 7 can be passed. FIG. 3 shows a further embodiment of a barrier according to the present invention, as generally indicated by arrow 100, the barrier 100 includes a connection portion having two protruding members 101, 102 on one end and three protruding members on the other end (not shown). The barrier 100 includes an aperture 8 through which a rigid straight elongate member (not shown) can be inserted into the shell 102. In the embodiment of FIG. 3 the rigid straight elongate member (not shown) but inserted through aperture 8*a* lies adjacent to the top surface 103 of connection portion protruding member 101. On the other end of the barrier (not shown) the rigid straight elongate member (not shown) lies adjacent to the bottom surface (not shown) of the top most connection portion protruding member (not shown). The rigid straight elongate member 200 (shown in FIGS. 4 and 5) includes a substantially straight rigid bar 201. At each end of the rigid straight elongate member 200 are apertures 202, 203 which are sized and positioned to align substantially co-axially with corresponding apertures 5*a*, 5*b* and 6*a*, 6*b* in the connection portions 3*a*, 4*a*, 101 of a plastic shell 2 of barrier 1, 100.

In FIG. 1 first aperture 8*a* is positioned adjacent the bottom surface of first connection portion 3*a* and a second aperture 8*b* is positioned adjacent the top surface of second connection portion 4*a*. The apertures 8*a*, 8*b* are aligned normal to opposing ends of the shell from the first connection portion to the second connection portion. In the embodiment of FIG. 1 the passage through the shell is substantially parallel to the base 9 of shell 2. Steel bar 7 is slid through an aperture 8*a* or 8*b* through the shell and out an opposing aperture 8*a* or 8*b*. The steel bar 7 is positioned parallel to the base 9 of shell 2 thereby providing a high level of tensile strength in the longitudinal direction of the shell 2. The apertures of steel bar 7 align co-axially with the apertures 5*a*, 5*b* and 6*a*, 6*b* of connection portions 3 or 4.

With respect to FIG. 2 there is shown three interconnected temporary barrier sections as generally indicated by arrow 20. First barrier section 21 second connection portion 4 is interlaced with second barrier section 22 first connection portion 3. First and second connection portion 3,4 vertically oriented apertures 5*a*, 5*b* (shown in FIG. 1) of first barrier section 21 and vertically oriented apertures 6*a*, 6*b* (shown in FIG. 1) of second barrier section 22 align coaxially and are pinned in position by fastening rods 24. Second barrier section 22 and third barrier section 23 are fastened together in a similar manner, first and second Connection portion 3,4 vertically oriented apertures 5*a*, 5*b* of second barrier section 22 and vertically oriented apertures 6*a*, 6*b* of third barrier section 23 align coaxially and are pinned in position by fastening rods 25.

During an impact between a vehicle and second barrier section 22 in direction A and impacting near point B, the second barrier section 22 experiences a vectored impact force. The force acts to push the barrier section 22 both in direction B and towards third barrier section 23. Second barrier section 22 is prevented from moving out of alignment with barrier sections 21 and 23 due to the impact forces being passed along steel bar 22*a* through connection portions 3 and 4 and fastening rods 24 and 25 into steel bar 21*a* and steel bar 23*a*. The steel bars in adjacent barrier sections pass the impact energy along a line of barrier sections (in this case only 3 are shown). Furthermore the plastic deformation (elongation) that would typically result in the body of adjacent connected barrier sections is avoided due to the tensile force being concentrated in the steel bar. In this manner the inertia of a single barrier section can be greatly increased due to the inertia of adjacent barrier sections.

Aspects of the present invention have been described by way of example only and it should be appreciated that modifications and additions may be made thereto without departing from the scope thereof as defined in the appended claims.

What I claim is:

1. A temporary plastic barrier section comprising:

a plastic shell having:

a height and a width;

a first plastic connection portion integrally formed on a first end;

a second plastic connection portion integrally formed on a second end opposite said first end;

wherein the first connection portion each and the second connection portion includes at least one connection point formed therein, said first and second connection portions each being oriented on an axis substantially parallel to the height of the plastic shell; and a rigid straight elongate member having at least one connection point at substantially each end thereof, wherein the rigid straight elongate member extends from the first connection portion to the second connection portion and wherein the connection points at each end of the rigid straight elongate member are located on the axis of the first and second connection portions and align substantially with the connection points formed in the first and second connection portions.

2. The temporary plastic barrier section as claimed in claim 1 wherein the plastic shell includes a passage which passes from an aperture near to or substantially adjacent the first connection portion to a position near to or substantially adjacent to the second connection portion.

3. The temporary plastic barrier section as claimed in claim 1 wherein the first and second connection portions are complementary.

4. The temporary plastic barrier section as claimed in claim 1 wherein the first and second connection portions are substantially identical.

5. The temporary plastic barrier section as claimed in claim 1 wherein the rigid straight elongate member provides tensile strength to substantially resist any longitudinal deformation of the plastic shell.

6. The temporary plastic barrier section as claimed in claim 1 wherein the rigid straight elongate member is configured to shear or break when subjected to a direct impact substantially orthogonal to the longitudinal axis of the rigid elongate member.

7. The temporary plastic barrier section as claimed in claim 1 wherein the rigid straight elongate member is a substantially straight steel bar.

8. The temporary plastic barrier section as claimed in claim 1 wherein the plastic shell has a base region and includes:

a first aperture therein positioned adjacent the first connection portion; and a second aperture therein positioned adjacent the second connection portion, wherein the apertures are aligned substantially parallel with respect to the base region on opposing ends of the plastic shell.

9. A temporary plastic barrier section, as claimed in claim 1, forming a section of a wall of interconnected temporary plastic barrier sections, wherein the rigid straight elongate member of the temporary plastic barrier section is connected to a rigid straight elongate member of an adjacent temporary plastic barrier section, thereby forming a chain of interconnected temporary plastic barrier sections.

10. The temporary plastic barrier section as claimed in claim 9 wherein the plastic shell includes apertures in the first and second connection portions which align coaxially with corresponding apertures in the portions of the rigid straight elongate member which lie adjacent the connection portions.

11. A rigid straight elongate member for use with a plastic shell; the plastic shell having a first and a second connection portion formed on opposite ends of the plastic shell; and having a passage which passes from an aperture near to or substantially adjacent the first connection portion to a position near to or substantially adjacent to the second connection portion;

wherein the rigid straight elongate member is configured to be passed through the passage in the plastic shell, and includes at least one connection point in the form of an aperture passing orthogonally through the rigid straight elongate member at substantially each end thereof; and wherein the rigid straight elongate member is configured so that when located in the plastic shell by way of the at least one aperture the at least one connection point in each end of the rigid straight elongate member lies substantially adjacent to a corresponding connection point located in the first and second connection portions of the said plastic shell.

* * * * *